US005547518A

United States Patent [19]

Johnson et al.

[11] Patent Number: 5,547,518

[45] Date of Patent: Aug. 20, 1996

[54] ENHANCED METHOD FOR CLEANING FOIL

[75] Inventors: Neil A. Johnson, Schenectady; Thomas R. Raber, East Berne; Louis E. Hibbs, Jr., Schenectady; Melissa L. Murray, Schaghticoke; Mark G. Benz, Burnt Hills, all of N.Y.

[73] Assignee: General Electric Company, Schenectady, N.Y.

[21] Appl. No.: 415,803

[22] Filed: Apr. 3, 1995

[51] Int. Cl.[6] ..... C22F 1/18

[52] U.S. Cl. ..... 148/98; 205/51; 205/212; 134/2

[58] Field of Search ..... 148/96, 98; 134/2; 205/51, 209, 210, 212

[56] References Cited

U.S. PATENT DOCUMENTS 3,217,405 11/1965 Das ..... 148/98

3,317,286 5/1967 De Sorbo ..... 205/51

FOREIGN PATENT DOCUMENTS 1342726 2/1970 United Kingdom .

OTHER PUBLICATIONS

"Binary Alloy Phase Diagrams", 2nd Edition, ASM International (1990), p. 2771.

"Efffect of Oxygen and Zirconium on the Growth and Superconducting Properties of Nb3Sn", L. E. Rumaner, Masters Thesis, CRD Technical Report, 91CRD124, Jun. 1991, pp. 1–135.

*Primary Examiner*—George Wyszomierski

*Attorney, Agent, or Firm*—Noreen C. Johnson; William H. Pittman

[57] ABSTRACT

Foils used to manufacture superconductor materials can effectively be cleaned by heat treatment prior to anodization and further processing steps. The heat treatment can be in conjunction with other cleaning processes or separate.

9 Claims, No Drawings

ENHANCED METHOD FOR CLEANING FOIL

FIELD OF THE INVENTION

This invention relates to a method for cleaning the surface of foil used in the manufacture of superconductor materials. In particular, this invention is directed to a high temperature anneal of foil that is used in the production of triniobium tin superconductors.

BACKGROUND OF THE INVENTION

The intermetallic compound triniobium tin, $Nb_3Sn$, is a type-II metallic superconductor of interest because it has high values of superconducting critical current density in high magnetic fields. In order to achieve high critical current density, the process chosen to form the triniobium tin superconductor is important. One process currently used is a liquid-solid phase diffusion method. This occurs by diffusion between a solid niobium phase and a liquid tin phase.

To form triniobium tin superconductors by liquid-solid diffusion requires multiple steps. The first step in forming triniobium tin superconductor is to clean the niobium based substrate. Historically, this is done with a cleaning solution or etchant, such as a mixture of nitric acid, hydrochloric acid, and water. Diluted hydrofluoric acid is also sometimes used for cleaning the substrate. Another method of cleaning the foil is mechanical abrasion of the surface of the foil, the subject of commonly owned and assigned, Patent Application entitled "Cleaning Method for Foil" application Ser. No. 08/415,804. After the substrate is cleaned, oxygen may be added to the surface of the substrate by anodizing the surface electrolytically.

The next three steps involve high temperature heat treatments. The first anneal, as taught by Caslaw in British patent 1,342,726, is used to introduce a desired oxygen content into the niobium substrate. This is accomplished by passing the substrate through a furnace at about 950° C. for about 30 seconds in an atmosphere containing argon and oxygen. However, if the substrate has been previously anodized to form an oxide layer on the surface of the substrate, then the preheat is called a decomposition anneal whereby the substrate is annealed so that the oxide layer diffuses into the body of the substrate.

After the preheat, the substrate is dipped in a tin or tin alloy bath, which supplies the tin for the triniobium tin reaction. The tin coating from the bath has a limiting thickness due to the amount of tin needed to further react with the niobium. Subsequently, the tin coated niobium substrate is treated with a reaction anneal to react the tin coating and the niobium base metal. During this final anneal, a layer of superconducting triniobium tin is formed on both sides of the niobium substrate.

In the above-mentioned steps the initial cleaning of the foil surface is important. A clean, unstained foil surface allows successful subsequent processing of the foil to form the triniobium tin superconductor. When the foil is not properly cleaned, surface staining from incomplete rinsing and drying of the foil after acid cleaning may occur. Stained foil cannot successfully be processed through all the necessary steps to make satisfactory triniobium tin tape. For instance, the amount of oxygen added during a subsequent anodization process is diminished in stained areas, reducing the thickness of the superconducting layer and lowering the critical current in those stained areas. Further, the tin alloy, which is also necessary for the formation of the superconductor, does not always wet the niobium foil surface in stained areas. This leaves areas on the foil where there is no superconducting material formed during the final reaction anneal.

There is a need for a method of cleaning the foil which would provide foil with a contaminant-free, uniform surface for subsequent superconductor process steps. There is also a need for a cleaning method that is compatible with the environment by eliminating the use of acids. Also, there is a need to reduce the cost of the manufactured tape by increasing the superconducting material yield.

SUMMARY OF THE INVENTION

This invention provides a method for cleaning foil to be used in manufacturing superconductor material that increases the oxygen content of the foil during anodization which improves the reaction kinetics in subsequent processing steps that form the superconductor material. This is accomplished by annealing the foil in an inert atmosphere at a high temperature. The heat treatment is applied by itself or in conjunction with acid dipping, mechanical cleaning, or a combination of both. The high temperature anneal is done prior to anodization of the foil in order to insure a consistently clean surface on the foil which will optimize the amount of oxygen added to the foil surface during anodizing.

This invention also includes a method for cleaning foil used in manufacturing a superconductor material comprising degreasing the foil; cleaning the foil by a method selected from the group consisting of acid cleaning, mechanical cleaning, and mixtures thereof; and then annealing the foil at a temperature between about 950°–1150° C. for at least about twenty seconds before processing the foil to make the superconductor material. It is also contemplated that the method comprises degreasing the foil in a received condition and heat treating the foil prior to anodizing or other processing steps to make superconductor foil for at least about 20 seconds at a temperature between about 950°–1150° C.

High temperature heat treatment during the cleaning cycle of the foil, and prior to anodization and decomposition annealing, improves the formation and quality of the superconductor. Most stains on the foil from acid cleaning are removed. The surfaces of mechanically abraded foil are further enhanced in the cleaning process. Thus, subsequent treatments of the foil, such as anodization and tin wetting for triniobiun tin superconductor, are improved, leading to high quality superconducting material.

Additionally, this invention can eliminate the use of acids from the cleaning process. As a result, handling and disposal of the acids no longer pose problems. This decreases manufacturing costs while having an environmental benefit.

DESCRIPTION OF THE INVENTION

The quality and uniformity of superconductor tape is improved by heat treating the foil in an inert atmosphere prior to subsequent treatments to form the superconducting material. The method of this invention involves annealing the foil at a high enough temperature to self getter the surface oxygen or drive the surface niobium oxide into the bulk of the foil. For a niobium-based foil, the binary phase diagram for niobium-oxide shows that at low concentrations and elevated temperatures, niobium and oxygen form a solid solution which makes this method of surface cleaning viable.

This invention is described herein for the manufacture of triniobium tin superconductor. However, it is also contemplated that the method of this invention is applicable to the cleaning of foil for use in manufacturing other superconducting materials. For example, with regard to metallic superconductors, it is known that selected parent-metals, either pure or preferably containing minor solute-metal alloying additions, are capable of being alloyed with other reactive metals and forming superconducting compounds or alloys that have a high current-carrying capacity. The parent-metals niobium, tantalum, technetium, and vanadium, can be reacted or alloyed with reactive metals, such as tin, aluminum, silicon, and gallium, to form superconducting alloys, such as the intermetallic triniobium tin. Thus, the method of this invention may be useful in manufacturing tapes of several different superconductors.

Generally, niobium-based foil first undergoes degreasing to remove slitting oils prior to the cleaning steps of this invention. Then, the surface of the foil is cleaned in preparation for anodization. In the practice of this invention, the heat treatment can be substituted in place of other cleaning methods, or combined in conjunction with acid cleaning or mechanical cleaning to remove niobium oxides and other contaminants from the surface of the foil.

The heat treatment or high temperature anneal cleaning step of this invention is now described. The heating of the foil takes place in an inert atmosphere such as nitrogen, argon, or a low oxygen environment. A low oxygen environment comprises an inert gas, such as argon or nitrogen, and up to about ten parts per million oxygen. The heat treatment is conducted at about 950°–1150° C. for at least about twenty seconds. The preferred temperature range is about 1000°–1100° C., and the most preferred temperature is about 1050° C. It is contemplated that heat treatments can be about five to about ten minutes or longer. However, longer times may not provide a benefit in terms of cleaner foil surfaces.

When using niobium-based foil, it preferably contains zirconium in the proportion of at least about one atomic percent. If desired, the percentage of zirconium may be increased up to about eight atomic percent.

Preferably, the thickness of the niobium-based foil is between about 0.0008–0.0012 inches. However, the foil thickness may be from greater than about 0.0005 to about 0.008 inches. The width of the foil depends on the application. Foils may be about 0.5–1.5 inches wide. Usually a one inch wide foil is used in production to produce triniobium tin tape.

Generally, foil that has been degreased and cleaned with acids first, allow higher processing rates of the foil using the method of this invention because much of the niobium oxide which forms on the surface of the foil has been removed by the acid. Foil that has only been degreased first, may require a longer heat treatment to consume the heavier oxide layer effectively.

To quantitatively evaluate the effectiveness of the cleaning of foil, the oxygen concentrations in foil samples that had been cleaned and anodized were measured. Data shows that the combined mechanical abrasion and annealing method provides a good alternative cleaning method to acid cleaning of foil.

The following examples further demonstrate the invention.

EXAMPLE

To determine the effectiveness of the cleaning process using high temperature anneal, the oxygen content of acid cleaned, abrasive cleaned, high temperature anneal cleaned, and a combination of abrasive cleaning and high temperature anneal cleaning of niobium-one atomic percent zirconium foils were compared after anodization. The amount of oxygen added during anodization is an indication of the foil surface cleanliness, with greater oxygen concentrations resulting from a cleaner foil surface.

Three different sources of foil, herein referred to as I, II, and III, of varying initial surface condition were used in this investigation. Each source of foil was degreased in either an agitated detergent solution or with trichloroethylene. Foil I was in good condition; it was shiny, smooth, and had no noticeable stains. Foil II had a dull surface and wrinkles due to poor spooling. Foil III had been previously mechanically cleaned with an abrasive pad. Table 1 gives the foil characteristics before using various cleaning processes.

TABLE 1

| FOIL SAMPLE | Foil Weight/ft (gm/ft [mil]) | as received appearance | degrease |
|---|---|---|---|
| I | 1.50 (0.89) | shiny | alconox |
| II | 1.61 (0.96) | dull mat | none |
| III | 1.62 (0.97) | roughened | tri-color |

Oxygen concentration was measured for the foil in the as received condition and after surface cleaning. Oxygen content was determined using a Leco 136 Oxygen/Nitrogen Analyzer. Results are shown in Tables 2.

TABLE 2

| OXYGEN CONTENT IN FOIL (AT %) BEFORE ANODIZATION | | | |
|---|---|---|---|
| FOIL | as received | abraded | annealed |
| I | 0.25 ± 0.01 | 0.24 ± 0.01 | 0.33 ± 0.01 |
| II | 0.16 ± 0.01 | | |
| III | 0.25 ± 0.0 | | |

Table 2 gives the oxygen concentration before anodization of the three sources of foil. Foil I, shiny and in good condition as received, was abraded and checked for oxygen content, and annealed and checked for oxygen content, all prior to anodization. Foil II, dull and mat, was checked for oxygen content in the as received condition before further processing. Foil III, abraded foil as received, was checked for oxygen content in the as received condition also, before further processing.

Foil I results demonstrate that the mechanical abrasion alone does not increase the oxygen content of the foil, but annealing at about 1050° C. for thirty seconds increases the oxygen concentration by 0.08 atomic percent.

Five types of cleaning were examined. Foil was processed in the as-received condition that was degreased only (sample 1). Foil was acid cleaned by immersion for ten seconds in an aqueous solution of 10% sulfuric acid, 30% nitric acid, and 8% hydrofluoric acid by volume. The samples were rinsed using warm tap water and then with deionized water and air dried at about 100° C. (sample 2). Foil was mechanically cleaned by passing the foil between an abrasive pad and a back supporting wheel. The abrasive pad and back supporting wheel rotated in opposite directions at about 2200 revolutions per minute and the linear foil speed was about fifteen feet per minute. Foil was passed through fabric wipers to remove the abraded material from the foil surface (sample 3). Foil was high temperature annealed at about 1050° C. for thirty seconds or five minutes (sample 4). The last foil sample was mechanically cleaned by the above process and annealed at about 1050° C. for thirty seconds (sample 5).

The foil samples were then statically anodized at an anodization potential of 145 V in an aqueous solution of seven grams of $Na_2SO_4$ per liter of water by immersing the sample in the solution of sodium sulfate and creating a DC potential between the foil, as the anode, and a stainless steel plate, as a cathode.

Table 3 shows the oxygen concentration after anodization. The uncleaned foil contained the least amount of oxygen, and the acid cleaned foil contained higher concentrations of oxygen. A combination of mechanical abrasion and annealing the foil provided a similar clean surface for anodization as the acid cleaning method. The oxygen concentrations in these samples differed by less than one percent from the acid cleaned samples

TABLE 3

OXYGEN CONTENT IN FOIL (AT %) AFTER ANODIZATION

| Cleaning method | Foil I (shiny) | Foil II (mat) | Foil III (abraded) |
|---|---|---|---|
| no clean | 2.35 ± 0.03 | 2.05 ± 0.05 | — |
| acid | 3.05 ± 0.08 | 2.84 ± 0.10 | 2.69 ± 0.05 |
| abraded | 2.95 ± 0.01 | 2.39 ± 0.05 | 2.12 ± 0.03 |
| annealed | 2.83 ± 0.08 a | 2.12 ± 0.09 | — |
| annealed | 2.74 ± 0.02 b | | |
| abraded + annealded | 3.02 ± 0.12 a | 2.87 ± 0.27 a | 2.47 ± 0.10 a |

a = 1050° C. for 30 seconds
b = 1050° C. for 5 minutes

What is claimed:

1. A method for cleaning niobium-based foil used in manufacturing a triniobium tin superconductor material comprising degreasing the foil; removing surface oxides from the foil by a method selected from the group consisting of acid cleaning, mechanical cleaning, and mixtures thereof; heat treating the foil at a temperature between about 950°–1150° C. for at least about 20 seconds in an inert atmosphere containing 10 parts per million or less thereby providing a clean surface on the foil to improve subsequent anodization and tin wetting of the foil; and then anodizing the foil.

2. A method according to claim 1 where the acid cleaning comprises an etchant selected from the group consisting of a mixture of nitric acid, hydrochloric acid, and water; and diluted hydrofluoric acid.

3. A method according to claim 1 where the mechanical cleaning comprises passing the foil between an abrasive pad and a back supporting wheel to remove contaminant layers from both sides of the foil.

4. A method according to claim 1 where the temperature of the heat treating is about 1000°–1100° C.

5. A method according to claim 4 where the temperature of the heat treating is about 1050° C.

6. A method according to claim 1 where the heat treating is about 30 seconds.

7. A method according to claim 1 where the heat treating is about 5 minutes.

8. A method according to claim 1 where the niobium-based foil is niobium-1 atomic percent zirconium foil.

9. A method of processing niobium-based foil used in manufacturing triniobium tin superconductor material comprising degreasing the foil in a received condition; heat treating the foil for at least about 20 seconds at a temperature between 950°–1150° C. in an inert atmosphere containing up to 10 parts per million oxygen so as to increase an oxygen content obtainable from anodization of the foil; and anodizing the foil.

* * * * *